US005088684A

United States Patent [19]

Torras et al.

[11] Patent Number: 5,088,684

[45] Date of Patent: Feb. 18, 1992

[54] LIGHTER-HOLDER FOR CIGARETTE PACKET

[75] Inventors: Gabriel Torras; Felipe Camacho, both of Barcelona, Spain

[73] Assignee: Mar Planet, S.A., Sabadell, Spain

[21] Appl. No.: 628,686

[22] Filed: Dec. 17, 1990

[30] Foreign Application Priority Data

Dec. 18, 1989 [ES] Spain ..... 8903775[U]

[51] Int. Cl.[5] ..... A24F 13/00

[52] U.S. Cl. ..... 248/682; 206/87

[58] Field of Search ..... 248/682, 684, 686, 213.2, 248/229, 309.1; 206/85-89

[56] References Cited

U.S. PATENT DOCUMENTS

| | | | |
|---|---|---|---|
| 148,355 | 3/1874 | Dennett | 248/229 |
| 3,608,704 | 9/1971 | Kopp . | |
| 4,000,812 | 1/1977 | Pisarski | 206/87 |
| 4,332,362 | 6/1982 | Leopold | 248/229 |
| 4,363,432 | 12/1982 | Warthen . | |
| 4,750,613 | 6/1988 | Kopp . | |
| 4,844,254 | 7/1989 | Jang . | |
| 4,852,729 | 8/1989 | Conte | 206/86 |
| 4,898,532 | 2/1890 | Bercik | 206/86 |

FOREIGN PATENT DOCUMENTS

| | | |
|---|---|---|
| 1316197 | 2/1962 | France . |
| 2414686 | 8/1979 | France . |
| 2199727 | 7/1988 | United Kingdom . |

*Primary Examiner*—David M. Purol
*Assistant Examiner*—Robert A. Olson
*Attorney, Agent, or Firm*—Browdy and Neimark

[57] ABSTRACT

Lighter-holder for cigarette packets, consisting in a laminated holder element (1), of a size and shape similar to those of a lighter (4), lengthened at the base with a lamina or plate (2) designed for insertion in the bottom of a packet (10) to keep the holder (1) in place and separable.

1 Claim, 1 Drawing Sheet

LIGHTER-HOLDER FOR CIGARETTE PACKET

BACKGROUND OF THE INVENTION

The present invention relates to a lighter-holder for cigarette packets, to be used for keeping a lighter together with a cigarette packet, and thus available when a cigarette is extracted in preparation for lighting.

DESCRIPTION OF THE PRIOR ART

As is well known, regular smokers who consume cigarettes from standard rigid or semi-rigid packets occasionally find themselves, when ready to smoke, without a lighter or matches. These items are often not at hand and take some time to find causing the smoker some anxiety.

SUMMARY OF THE INVENTION

The primary objective of the inventive device described, is to provide to smokers access to a lighter at the time the smoker is ready to withdraw a cigarette from its packet. A further objective is to assure that the lighter is visible at the time of withdrawing a cigarette.

For a better understanding of the present invention and to show more clearly how it may be carried into effect reference will now be made, by way of example, to the accompanying drawings in which:

Figure 1:
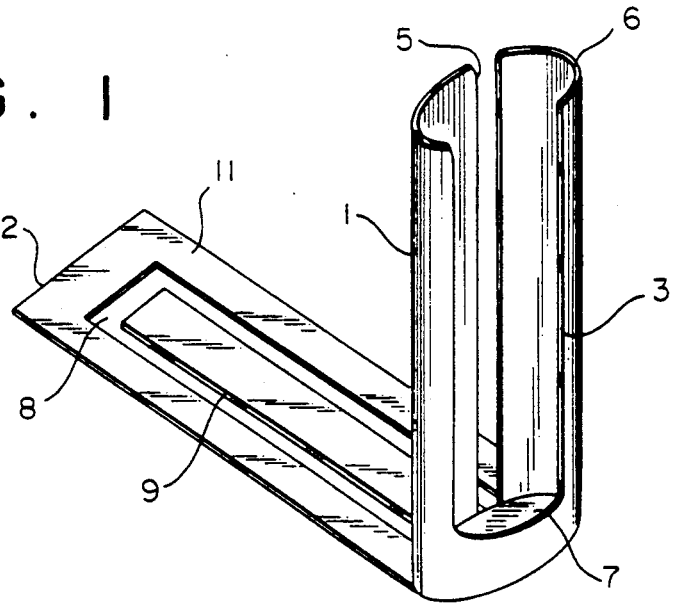
FIG. 1 is a perspective of the new lighter carrier and holder.
Figure 2:
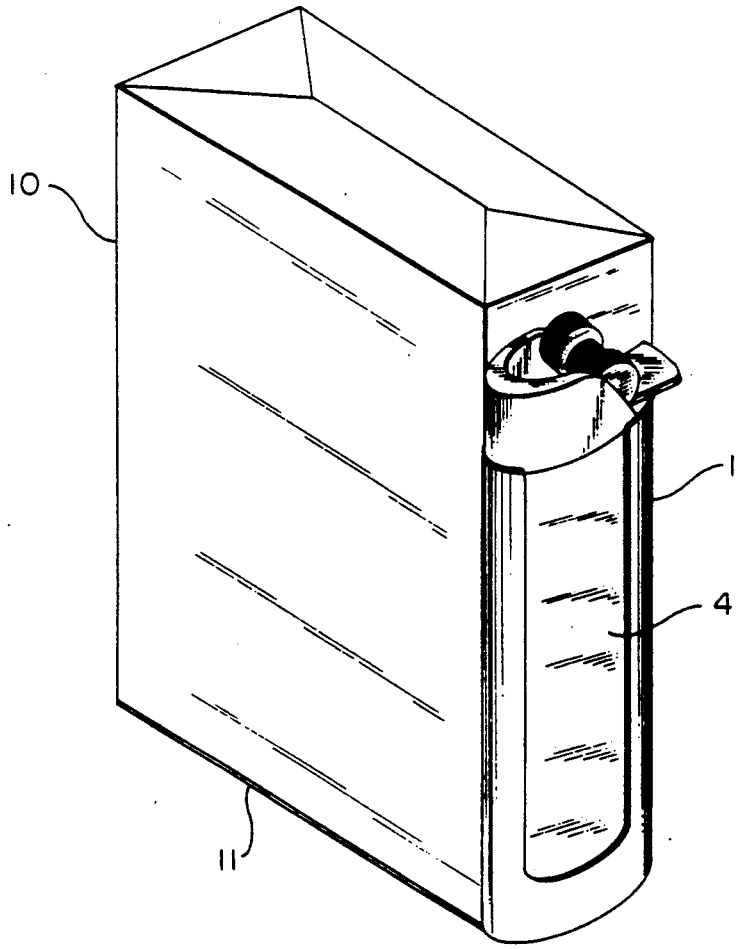
FIG. 2 represents the device described fitted to a cigarette packet and holding a lighter ready for immediate use.

The elements marked with numbers in the drawings correspond to the parts mentioned below.

DESCRIPTION OF PREFERRED EMBODIMENTS

The inventive device described and claimed comprises a holder element (1) and a long flat extension (2) extending laterally or perpendicular to the holder. Both the holder (1) and the extension (2) are obtained by stamping-out the device from a single laminated piece. The piece is preferably made of ferric metal plate, and can be heat-treated to increase resistance to impacts and abrasions. However, other materials, such as plastic can also be used to make the inventive device.

Holder (1) is substantially the same shape and size as a conventional lighter, such as those, disposable or otherwise, with flint and a container for gas or liquid fuel. The internal dimensions of the holder are slightly larger than those of a conventional lighter to ensure easy insertion of the lighter while still providing a tight fit around the lighter. The fit between the lighter and holder (1) can be made tighter in other ways such as indentations on holder (1) (not shown). At the front, holder (1) has a vertical cut-out (3) which exposes part of the lighter body (4), and at the rear, which will be adjacent to a cigarette packet, a slot (5), to provide for resilient expansion of the holder (1) to accommodate different lighter sizes. Top (6) of the holder is open to allow the insertion and use of the lighter.

The extension (2) has an oblong shape along its longitudinal axis and extends laterally or perpendicular from base (7) of the holder (1). Extension (2) further comprises a U-shaped slot (8) which produces a flap (9) with some resilience to help in keeping the holder (1) and a lighter therein, against the body of the packet (10).

The attachment of the inventive device described to a cigarette packet is carried out by inserting the extension (2) into one of the edges or short sides of the base of the packet so that its outside part (11) remains, for example, on the inside and the flap, on the outside, or vice versa. With extension (2) held in place, the holder is firmly attached to the packet with the lighter (4) contained therein. Thus, the lighter (4) becomes immediately available at any time.

The foregoing description of the specific embodiment so fully reveals the general nature of the invention that others can, by applying current knowledge, readily modify and/or adapt for various applications such specific embodiment without departing from the generic concept, and, therefore, such adaptions and modifications should and are intended to be comprehended within the meaning and range of equivalents of the disclosed embodiment. It is to be understood that the phraseology or terminology employed herein is for the purpose of description and not of limitations.

What is claimed is:

1. A lighter holder for cooperation with the bottom of cigarette packets and conventional lighters comprising;

a laminated resilient holder element with a size and shape corresponding to that of a conventional lighter;

said holder having a base at a bottom of said holder, an inner side adapted to be adjacent to a cigarette packet, and an outer side;

said inner side of said holder having a vertical slot for resilient expansion of said holder;

said outer side of said holder having a wide vertical cut-out for revealing lighters;

an extension plate integrally fixed to said base, perpendicular to a longitudinal axis of said holder and extending laterally from said base for insertion into a bottom of a cigarette packet; and said extension having a longitudinal U-shaped slot producing a resilient longitudinal flap fully within said extension for use in keeping said extension in contact with the bottom of the cigarette packets.

* * * * *